US009926111B2

(12) United States Patent
Krueger et al.

(10) Patent No.: US 9,926,111 B2
(45) **Date of Patent: *Mar. 27, 2018**

(54) TAMPER EVIDENT PLASTIC FOOD CONTAINER WITH TRIGGER OPEN MECHANISM

(71) Applicant: Anchor Packaging, Inc., St. Louis, MO (US)

(72) Inventors: Kevin Krueger, Fenton, MO (US); Bruce Stein, Ballwin, MO (US)

(73) Assignee: Anchor Packaging, Inc., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/294,108

(22) Filed: Oct. 14, 2016

(65) Prior Publication Data

US 2017/0088316 A1 Mar. 30, 2017

Related U.S. Application Data

(63) Continuation of application No. 14/869,135, filed on Sep. 29, 2015, now Pat. No. 9,475,621.

(51) Int. Cl.
*B65D 43/16* (2006.01)
*B65D 43/26* (2006.01)

(52) U.S. Cl.
CPC ..... *B65D 43/164* (2013.01); *B65D 43/26* (2013.01); *B65D 2101/0023* (2013.01); *B65D 2543/00833* (2013.01)

(58) Field of Classification Search
CPC .. B65D 43/166; B65D 43/164; B65D 43/163; B65D 43/16; B65D 43/0237;
(Continued)

(56) References Cited

U.S. PATENT DOCUMENTS 2,915,214 A 12/1959 Frankel
4,218,808 A 8/1980 Chu
(Continued)

FOREIGN PATENT DOCUMENTS

AU WO2006119538 11/2006
EP 1695919 8/2006
(Continued)

OTHER PUBLICATIONS

Co-pending U.S. Appl. No. 14/788,024, filed Jun. 30, 2015.
Co-pending U.S. Appl. No. 14/788,054, filed Jun. 30, 2015.
(Continued)

*Primary Examiner* — Robert J Hicks
(74) *Attorney, Agent, or Firm* — Don V. Kelly; Evans & Dixon, L.L.C.

(57) ABSTRACT

A tamper-evident container comprises a lid and a base. The lid includes a lid rim. The base includes a base rim. A frangible hinge is formed between a lid hinge segment extending outwardly from the lid rim and a base hinge segment extending outwardly from the base rim. The lid hinge segment includes at least one thumb rest that is positioned, sized and shaped to receive the thumb on a user's hand. The thumb rest has a counterpart finger rest located on the base hinge segment that is positioned, sized and shaped to receive a finger on the user's hand while the thumb of the same hand is in contact with the thumb rest. The frangible hinge is configured to rupture when the container is in the initially sealed arrangement by the application of a pushing force to the thumb rest and a contemporaneous pulling force to the finger rest.

8 Claims, 11 Drawing Sheets

(58) Field of Classification Search
CPC .. B65D 43/0235; B65D 43/26; B65D 17/163; B65D 17/161; B65D 17/16; B65D 17/24
USPC ... 220/270, 266, 265, 4.23, 4.24, 4.22, 4.21, 220/212.5, 810, 837, 836, 657
See application file for complete search history.

(56) References Cited

U.S. PATENT DOCUMENTS

| | | | | |
|---|---|---|---|---|
| 4,273,249 | A | 6/1981 | Florian | |
| 5,242,696 | A | 9/1993 | McDevitt | |
| 5,897,011 | A | 4/1999 | Brilliant | |
| 5,938,068 | A * | 8/1999 | Atkins | B65D 43/162 220/266 |
| 6,135,304 | A | 10/2000 | Wysiotsky | |
| 6,572,909 | B1 | 6/2003 | Bagwell et al. | |
| 7,073,680 | B2 | 7/2006 | Boback et al. | |
| 7,118,003 | B2 | 10/2006 | Sellari et al. | |
| 7,246,714 | B2 | 7/2007 | Garg et al. | |
| D587,993 | S | 3/2009 | Vovan | |
| 7,568,589 | B2 | 8/2009 | Vovan | |
| 7,631,776 | B2 | 12/2009 | Vovan | |
| 7,685,677 | B2 | 3/2010 | Garg et al. | |
| 7,712,626 | B2 | 5/2010 | Vovan | |
| 7,992,743 | B2 | 8/2011 | Vovan | |
| 8,056,750 | B2 | 11/2011 | Vovan | |
| 8,083,089 | B2 | 12/2011 | Vovan | |
| 8,123,064 | B2 | 2/2012 | Vovan | |
| 8,251,249 | B1 | 8/2012 | Vovan | |
| 8,371,468 | B2 | 2/2013 | Sellari et al. | |
| D693,672 | S | 11/2013 | Bontrager et al. | |
| 8,608,008 | B2 | 12/2013 | Gingras et al. | |
| D698,241 | S | 1/2014 | Fosse | |
| 8,672,166 | B2 | 3/2014 | Nazareth et al. | |
| 8,795,580 | B2 | 8/2014 | Sellari et al. | |
| 8,833,589 | B2 | 9/2014 | Vovan | |
| 8,851,315 | B2 | 10/2014 | Vovan | |
| 8,939,307 | B2 | 1/2015 | Gingras | |
| 9,016,503 | B2 | 4/2015 | Barbier | |
| 9,475,621 | B1 | 10/2016 | Krueger | |
| 2004/0118848 | A1 | 6/2004 | Marshall | |
| 2007/0045317 | A1 | 3/2007 | Rosender | |
| 2008/0023471 | A1 | 1/2008 | Garg et al. | |
| 2008/0308557 | A1 | 12/2008 | Kyle et al. | |
| 2009/0090712 | A1 | 4/2009 | Vovan et al. | |
| 2010/0072217 | A1 | 3/2010 | Parikh et al. | |
| 2010/0102074 | A1 | 4/2010 | Parikh et al. | |
| 2010/0181323 | A1 | 7/2010 | Thaler | |
| 2011/0000929 | A1 | 1/2011 | Brown et al. | |
| 2012/0067009 | A1 | 3/2012 | Bontrager et al. | |
| 2012/0181280 | A1 | 7/2012 | Barbier | |
| 2013/0175280 | A1 | 7/2013 | Stodd | |
| 2014/0069922 | A1 | 3/2014 | Boback et al. | |
| 2016/0185490 | A1 | 6/2016 | Wang | |

FOREIGN PATENT DOCUMENTS

| | | |
|---|---|---|
| EP | 2210819 | 6/2012 |
| EP | 2580138 | 4/2014 |
| WO | WO2003022703 | 3/2003 |
| WO | WO2005009857 | 2/2005 |
| WO | WO2005056414 | 6/2005 |
| WO | WO2008008343 | 1/2008 |

OTHER PUBLICATIONS

Co-pending U.S. Appl. No. 14/788,074, flied Jun. 30, 2015.
Office Action dated Sep. 21, 2016 in co-pending U.S. Appl. No. 14/788,024.
Office Action dated Sep. 22, 2016 in co-pending U.S. Appl. No. 14/788,054.
Office Action dated Nov. 18, 2015 in co-pending U.S. Appl. No. 14/788,074.
Office Action dated May 4, 2016 in co-pending U.S. Appl. No. 14/788,074.
Notice of Allowance dated Oct. 7, 2016 in co-pending U.S. Appl. No. 14/788,074.
Co-pending U.S. Appl. No. 14/869,135, filed Sep. 29, 2015.
Co-pending U.S. Appl. No. 29/536,250, filed U.S. Appl. No. 29/536,250.

* cited by examiner

TAMPER EVIDENT PLASTIC FOOD CONTAINER WITH TRIGGER OPEN MECHANISM

CROSS REFERENCE TO RELATED APPLICATION

This Application is a continuation of U.S. patent application Ser. No. 14/869,135 filed on Sep. 29, 2015. The entire contents of that application are herein incorporated by reference.

STATEMENT REGARDING FEDERALLY SPONSORED RESEARCH OR DEVELOPMENT

Not applicable.

SEQUENCE LISTING, TABLE OR COMPUTER PROGRAM ON COMPACT DISC

Not applicable.

FIELD OF INVENTION

This invention relates generally to plastic food containers. The invention is more specifically related to resealable plastic food containers having tamper evident sealing mechanisms.

BACKGROUND OF THE INVENTION

It is known to use plastic containers in the food preparation and restaurant industry to package prepared foods. The typical food container of the prior art consists of a clear or solid colored base and a clear lid. In order to maintain the quality of food contents and prevent tampering with the contents of a sealed container, it is desirable that the food container, once initially sealed, not be capable of being initially opened without visible indication of the container having been opened. To achieve this feature, container manufacturers have designed containers having integral tamper evident features. Typically, these containers consist of a lid that is hingedly attached to a base. The lid seals to the base by superposing the rim of the lid upon the rim of the base or inserting the lid rim within the confines of the base rim. These types of plastic containers are sold as one-piece containers and are often referred to as "clamshell" containers or packages.

There are several general types of tamper evident clamshell food containers. One type involves utilizing a tear-away or break-away mechanism at the sealing side (non-hinged side) of the container. In this type of container the lid and base each have interlocking elements respectively located on or near the lid rim and base rim where the two rims meet when the container is sealed (i.e., at a non-hinged side or portion of the container). The interlocking element of the lid or base is conventionally located on a tab or flange extending from the rim of the lid or base. Either or both of the tabs are attached to their respective rims by a frangible section of plastic. When the lid and base are placed in initial sealing arrangement, the interlocking elements on or near the lid rim and base rim engage and lock together. In order to open the initially sealed container, the frangible section of one or both tabs must be ruptured so as to release the tab or tabs from the container. Because the interlocking sealing elements are located on the tabs, rupturing one or more tabs from the container disables the locking mechanism. The ruptured tab provides evidence of the container having been opened. One shortcoming with the prior art food container described above is that the interlocked tabs can be cut from the container in clean fashion using scissors or another cutting implement so as to remove any indicia of the container having had a tamper evident mechanism.

Other types of clamshell containers incorporate the tamper evident mechanism as part of the structure that forms or includes the hinge. In these containers, the container is designed to require a severance near the hinge in order to unseal (initially open) the container. This construct make the hinge a single use hinge. These types of hinges often utilize some type of tear strip or tab lifting mechanism to rupture the hinge area. In other cases, the hinge structure is adapted to break by application of a squeeze force that causes the relative movement of two-adjacent sides (the top flange and the vertical span of material) that form the hinge arrangement. The various hinge rupturing mechanisms are typically complex requiring intricate geometry and forming to make the container. Also due to the large span between the lid flange and base flange, additional amounts of plastic are needed to form the container. Containers with tear-strips and break-away tabs are also ecologically unfriendly and present disposal issues for the consumer. In this respect, after rupturing the tamper-evident seal the user is left with a piece of plastic that needs to be separately discarded from the remaining container. There is thus a need in the art for a re-closeable plastic food container that is easy for end consumers to operate; combines reliable tamper evidence and defense against prying intrusion; and that uses a minimum of material to manufacture.

SUMMARY OF THE INVENTION

The present invention satisfies the needs in the art and provides an aesthetically appealing food container that is tamper resistant, tamper evident and easy to use. In this respect the present invention food container offers a novel opening mechanism that employs a completely distinct hand/finger action to open the container at the hinge area. The structure utilized in forming the hinge mechanism includes structure that allows a user to use his or her thumbs and index fingers against structures embossed upon the extensions from the rims or flanges of the container and sever the hinge of the container with a simple trigger pulling motion.

In the preferred embodiment, the invention is directed to a tamper evident container capable of assuming an open arrangement (state) and an initially sealed arrangement. The container can also assume an unsealed state. The container comprises a lid and a base. The lid includes a cover surface and a lid rim. The lid rim circumferentially extends about the periphery of the lid. The base includes a base rim circumferentially extending about the periphery of the base. The container further includes a frangible hinge. The hinge is formed between a lid hinge segment extending outwardly from the lid rim and a base hinge segment extending outwardly from the base rim. The lid hinge segment includes at least one thumb rest that is positioned, sized and shaped to receive the tip or bottom surface of a thumb on a user's hand. The at least one thumb rest has a counterpart finger rest located on the base hinge segment that is positioned, sized and shaped to receive the tip or bottom surface of a finger on the user's hand while the thumb of the same hand is in contact with the thumb rest. The frangible hinge is configured to rupture when the container is in the initially sealed arrangement by the application of a pushing force applied by the thumb of a user's hand to the thumb rest and a contemporaneous pulling force applied by a finger from the same hand to the finger rest. The term "pushing force" includes not just an actual pushing force, but also a force holding the thumb rest against movement in the face of an actual pulling force applied to the finger rest. Similarly, the term "pulling force" includes not just an actual pulling force, but also a force holding the finger rest against movement in the face of an actual pushing force applied to the thumb rest.

In an alternate embodiment, the invention is directed to a tamper evident container capable of assuming an open arrangement and an initially sealed arrangement. The container comprises a lid and a base. The lid includes a lid rim circumferentially extending about the periphery of the lid; and the base includes a base rim circumferentially extending about the periphery of the base. The lid rim and the base rim are configured to frictionally engage each other when the container is in the initially sealed arrangement. The container includes a frangible hinge that is formed between a lid hinge segment extending outwardly from the lid rim and a base hinge segment extending outwardly from the base rim. The frangible hinge is configured to rupture when the container is in the initially sealed arrangement by the application of a pushing force to the lid hinge segment and a pulling force to the base hinge segment that results in the relative horizontal movement of the lid hinge segment and the base hinge segment extension away from each other.

Either embodiment may be varied to include the following features. For example, the lid rim may include an outwardly extending lid rim flange circumferentially extending about the periphery of the lid. In such case, the lid hinge segment extends outwardly from a portion of the lid rim flange. Similarly, the base rim may include an outwardly extending base rim flange circumferentially extending about the periphery of the base and the base hinge segment would extend outwardly from a portion of the base rim flange.

In terms of location, shape and position of the at least one thumb rest, the thumb rest is located on the top surface of the lid hinge segment. The at least one thumb rest projects upwardly from the top surface of the lid hinge segment. In complementary fashion, the base hinge segment includes a bottom surface. The finger rest projects downwardly from the bottom surface of the base hinge segment. The container can be opened in a fashion that is significantly simpler than needed for other tamper evident containers. Specifically, to open the container a pushing force is applied by the user's thumb and contemporaneous a pulling force is applied by the user's finger from the same hand of the user. The container may include other features as herein described in more detail.

DETAILED DESCRIPTION

Figure 6:
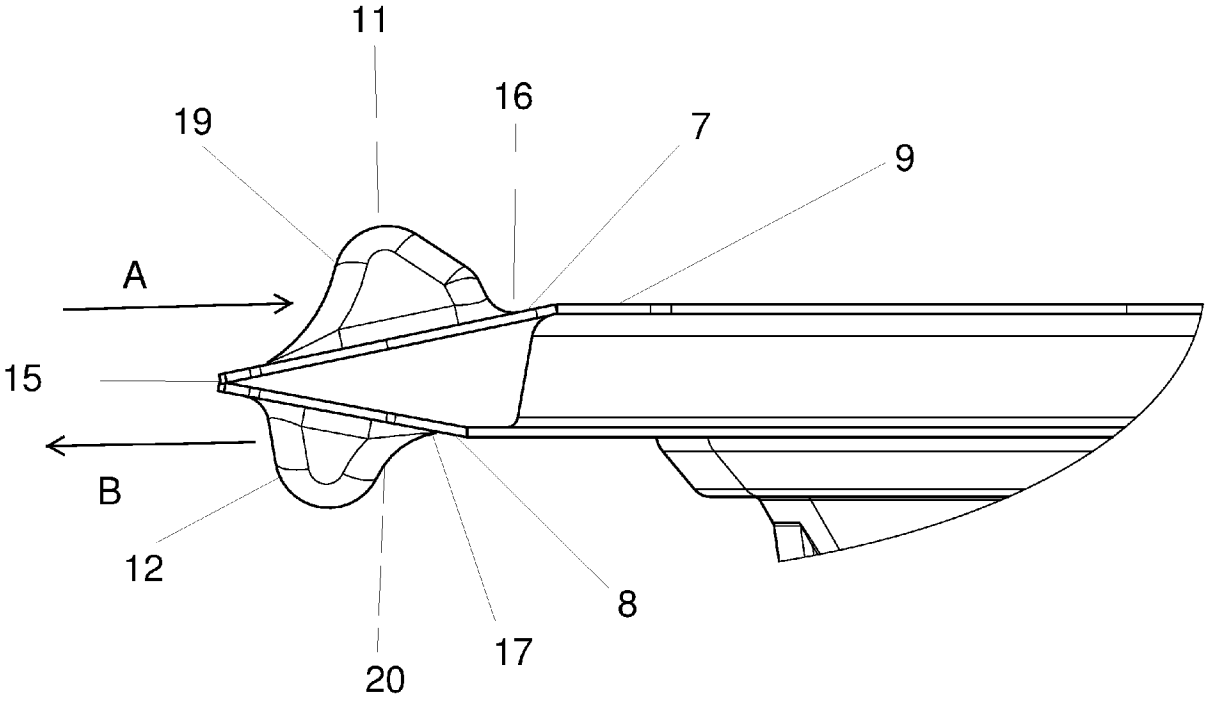
FIG. 6 is a detail left elevation view of the hinge area structure of the container in the initially sealed arrangement.
Figure 7:
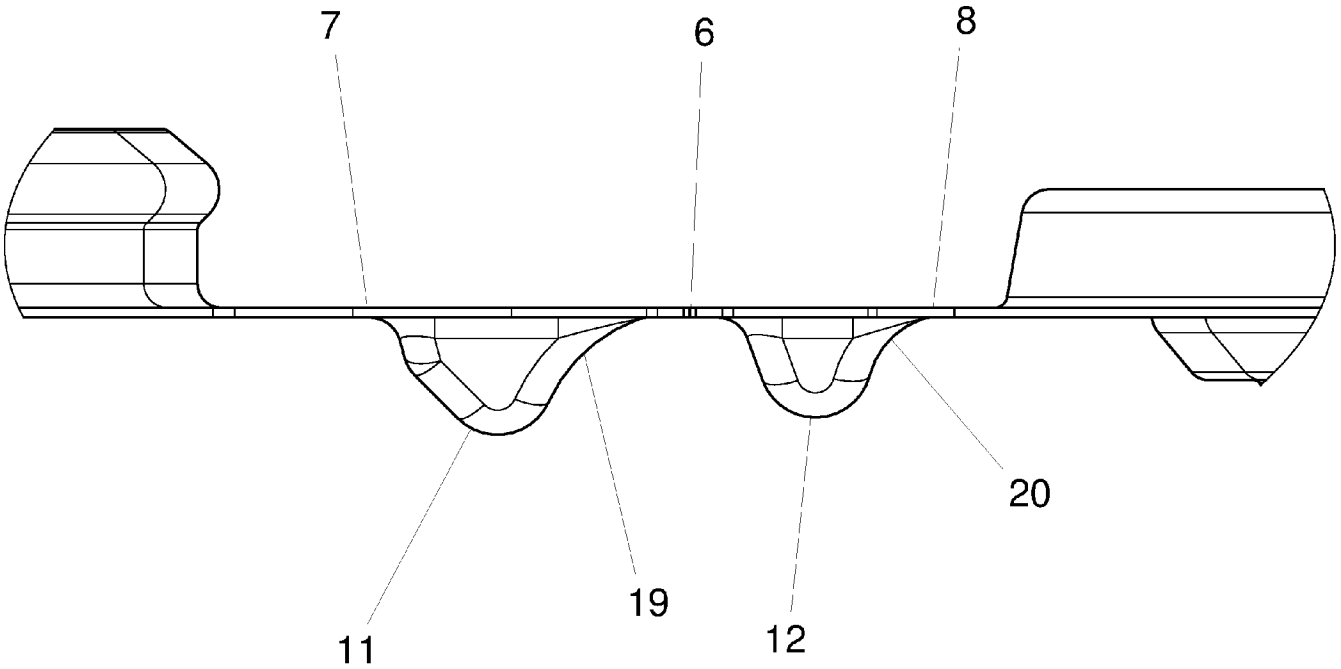
FIG. 7 is a detail left elevation view of the hinge area structure of the container in the open arrangement.

FIGS. 1-11 depict a preferred embodiment present invention tamper evident plastic container 1 along with its preferred features. As is seen in the figures, the inventive container 1 includes a lid 2 and a base 3 that are attached to each other through a hinge 6 located on one side of the container. In practical use, the outer surface of floor 26 of base 3 will normally rest upon a surface (such as a table top) considered horizontal in reference to the user. Thus, the directional terms "vertical" and "horizontal" and the like are used to describe the container 1 and its components with respect to the orientation illustrated in FIGS. 1-11 and are employed merely for the purposes of clarity and illustration. For example, FIG. 6 shows the hinge area of container 1 when container 1 is in an initially sealed state. In the orientation shown in FIG. 6, at the point where lid hinge segment 7 connects to lid rim flange 9, lid hinge segment 7 is spaced "vertically" above base hinge segment 8. The directional terms "inner" and "inwardly" and the like are used herein with respect to the described container to refer to directions along the directional component toward the geometric center of the container. The directional terms "outer," "peripherally" and the like are used herein with respect to the described container to refer to directions along the directional component away from the geometric center of the container. Additionally, the terms "upward," "downward" and the like are used to describe spatial relationships among structure when lid 2 of container 1 is sealed or closed upon the base 3.

As shown in the figures, lid 2 and base 3 respectively include lid rim 4 and a base rim 5. Lid rim 4 may include peripherally projecting lid rim flange 9 circumferentially surrounding rim 4. Base rim 5 similarly may include base rim flange 10 circumferentially surrounding rim 5. Unlike other tamper evident containers that use a square-shaped, multi-segmented hinge structure, hinge 6 of the preferred embodiment container is confined to a vertex 15 that is vertically situated at a position interposed between the height of lid rim flange 9 and height of the base rim flange 10. Further, as can be particularly seen in FIG. 6, the interposed frangible vertex 15 projects horizontally and peripherally out from the container.

Figure 8:
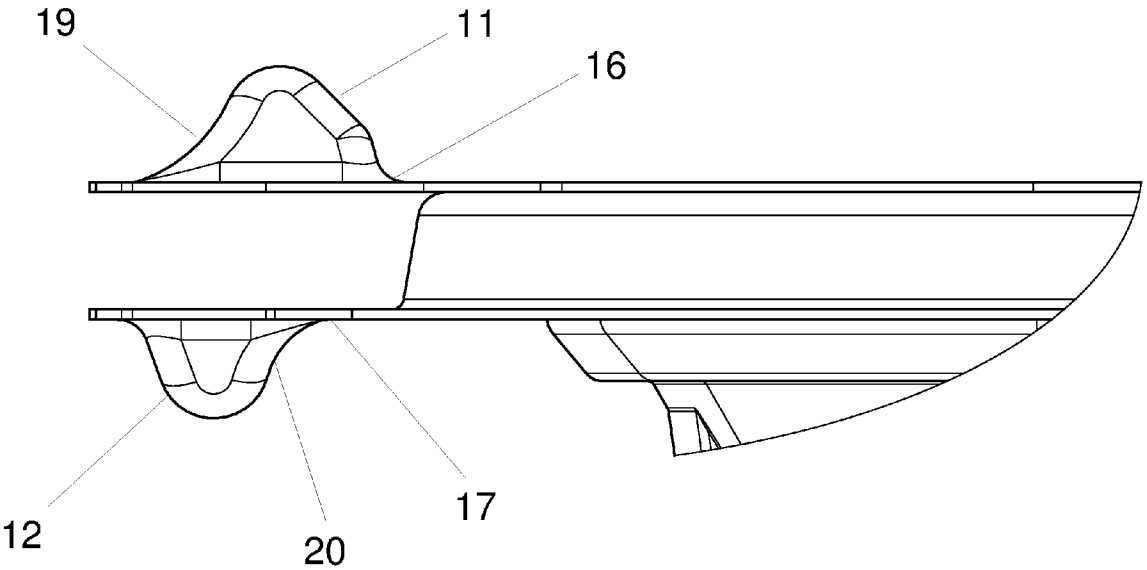
FIG. 8 is a detail left elevation of the hinge area structure, showing the rupture of the hinge as a result of application of trigger action force to the lid and base hinge segments.
Figure 9:
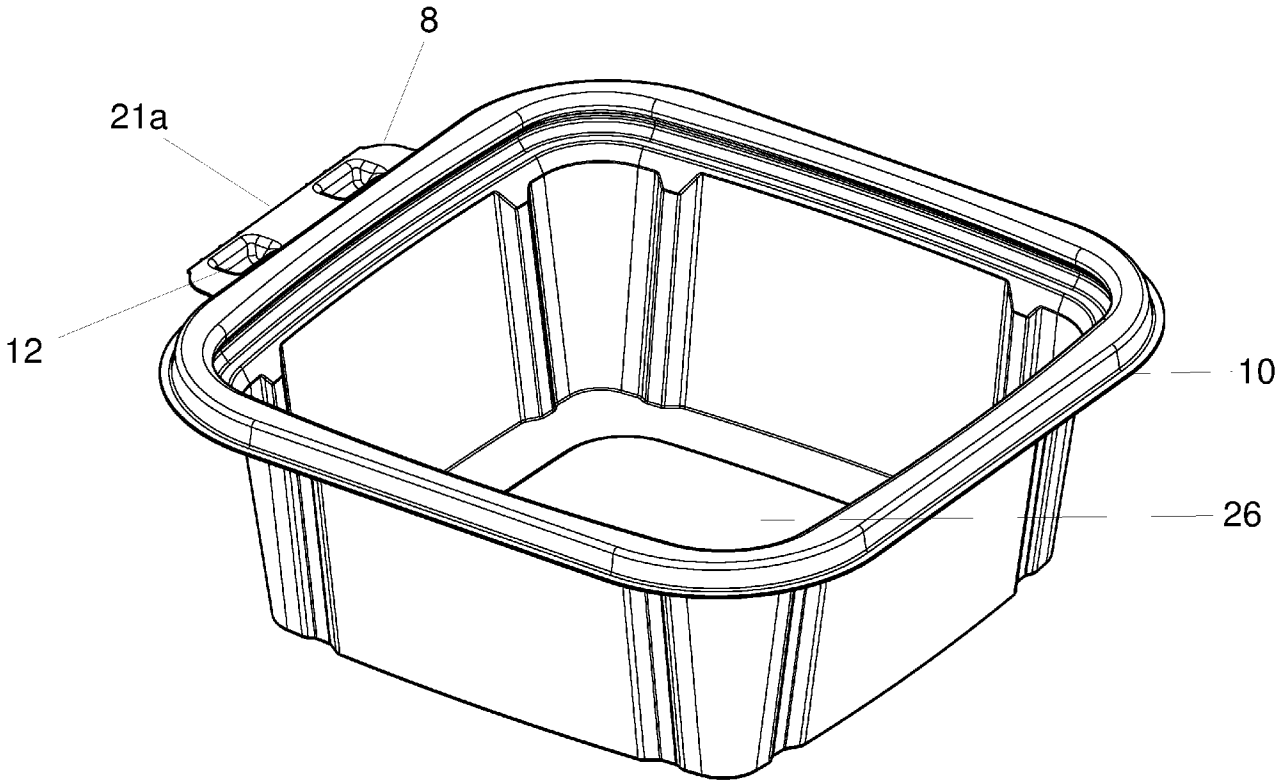
FIG. 9 is a front perspective view of the base of the preferred embodiment container, the container having been unsealed and the lid removed.
Figure 10:
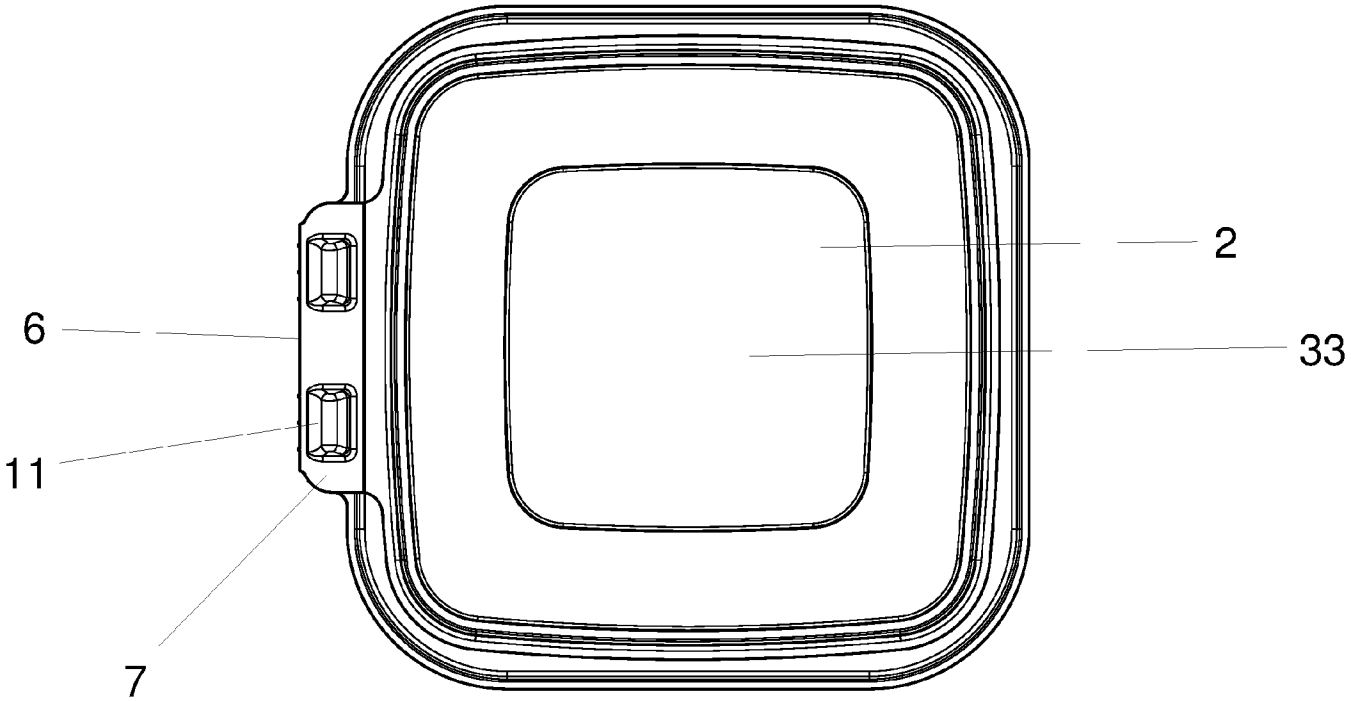
FIG. 10 is a top plan view of an embodiment of the container in the initially sealed arrangement.

As shown in the figures, preferred embodiment container 1 is capable of assuming an open arrangement or state (FIGS. 1-3, 7), an initially sealed arrangement (FIGS. 4-6, 10), and an unsealed arrangement (FIG. 8 (unsealed with lid not removed); FIG. 9 (unsealed with lid removed)). Additionally, container 1, after being unsealed from the initially sealed state can be closed. The first embodiment container comprises lid 2 and base 3. Lid 2 includes cover portion 33 and lid rim 4. Lid rim 4 circumferentially extends about the periphery of lid 2. A preferred embodiment rim and cover structure (including elongate cover beads) is described and shown in co-pending United States Patent and Trademark. Office patent application Ser. Nos. 14/788,024; 14/788,054 and 14/788,074, which applications are fully incorporated herein by reference.

As is seen in the figures, at the hinge area of container 1, lid rim flange 9 extends out and connects to lid hinge segment 7. In the same area, base rim flange 10 extends out and connects to base hinge segment 8. As can be readily seen, when container 1 is in the initially sealed arrangement, lid and base hinge segments 7, 8 project out respectively from flanges 9, 10 and converge to form vertex 15. Frangible vertex 15 projects peripherally out from container 1. Hinge 6 is defined by vertex 15 and is the point about which lid 2 and base 3 articulate for initially sealing and closing of the container.

Hinge 6 is preferably formed between lid hinge segment 7 that peripherally projects from lid rim 4 (more preferably via lid rim flange 9) and base hinge segment 8 that peripherally projects from base rim 5 (more preferably via base rim flange 10). Lid hinge segment 7 further preferably projects downwardly from lid rim flange 9 and base hinge segment 8 preferably projects upwardly from base rim flange 10.

The depicted embodiment container in the figures includes two thumb rests 11 each having a counterpart finger rest 12. Other arrangements are possible. For example, the container could have multiple thumb rests 11 that share a single (preferably elongated) finger rest 12. Alternatively, the container could have only one thumb rest 11 and one finger rest 12 (both preferably elongated and extending more of the length of hinge 6). The container could also have multiple finger rests 11 that share a (preferably elongated) thumb rest 12. As can be particularly seen in FIG. 11 of the figures, lid hinge segment 7 includes at least one thumb rest 11 that is positioned, sized and shaped to receive the tip or bottom surface of a thumb 14 on a user's hand. The at least one thumb rest 11 has a counterpart finger rest 12 located on base hinge segment 8 that is positioned, sized and shaped to receive the tip or palmar surface of a finger on the same hand while the hand's thumb is in contact with thumb rest 11. Frangible hinge 6 is configured to rupture when container 1 is in the initially sealed arrangement by the application of a pushing (horizontally inward) force A to thumb rest 11 and a contemporaneous pulling (horizontally outward) force B to finger rest 12.

In an alternate embodiment, the invention is directed to a tamper evident container 1. Container 1 is capable of assuming an open arrangement and an initially sealed arrangement. Container 1 comprises lid 2 and base 3. Lid 2 includes lid rim 4 circumferentially extending about the periphery of lid 1 and base 3 includes base rim 5 circumferentially extending about the periphery of base 3. Lid rim 2 and base rim 3 are configured to frictionally engage each other when container 1 is in the initially sealed arrangement. Container 1 includes frangible hinge 6 that is formed between lid hinge segment 7 that extends outwardly from lid rim 4 and base hinge segment 8 that extends outwardly from base rim 3. Frangible hinge 6 is configured to rupture when container 1 is in the initially sealed arrangement by the application of a pushing force to lid hinge segment 7 and a pulling force to base hinge segment 8 that results in the relative horizontal movement of lid hinge segment 7 and base hinge segment 8 away from each other. In the preferred embodiment, the hinge will rupture when the lid hinge segment moves inwardly, the base hinge segment moves outwardly or both movements occur.

Either embodiment may be varied to include the following features. For example, lid rim 4 may include outwardly extending lid rim flange 9 circumferentially extending about the periphery of lid 2. Lid hinge segment 7 would extend outwardly from a portion of lid rim flange 9. Similarly, base rim 5 may include outwardly extending base rim flange 10 circumferentially extending about the periphery of base 3. Base hinge segment 8 would extend outwardly from a portion of base rim flange 10 to form hinge 6 with lid hinge segment 7.

The at least one thumb rest 11 is located on top surface 16 of lid hinge segment 7. At least one thumb rest 11 projects upwardly from top surface 16 of lid hinge segment 7. In complementary fashion, base hinge segment 8 includes bottom surface 17. Counterpart finger rest 12 projects downwardly from bottom surface 17 of base hinge segment 8. Thumb rest 11 is sized, shaped and positioned on lid hinge segment 7 to comfortably receive the tip or palmar surface of the thumb of a user's hand while at the same time the tip or palmar surface of a finger on the same hand is in contact with finger rest 12. So that the thumb can have optimal purchase against thumb rest 11, the outward side 19 of thumb rest 11 is concave so as to receive the convex form of the tip or palmar surface of a thumb. Likewise, so that the employed finger of the same user's hand can have optimal purchase against finger rest 12, the inward side 20 of finger rest 12 is concave so as to receive the convex form of the tip or palmar surface of a finger. The outward and inward sides 19, 20 may include knurling (not shown) to increase frictional contact with the user's thumb and finger.

Figure 11:
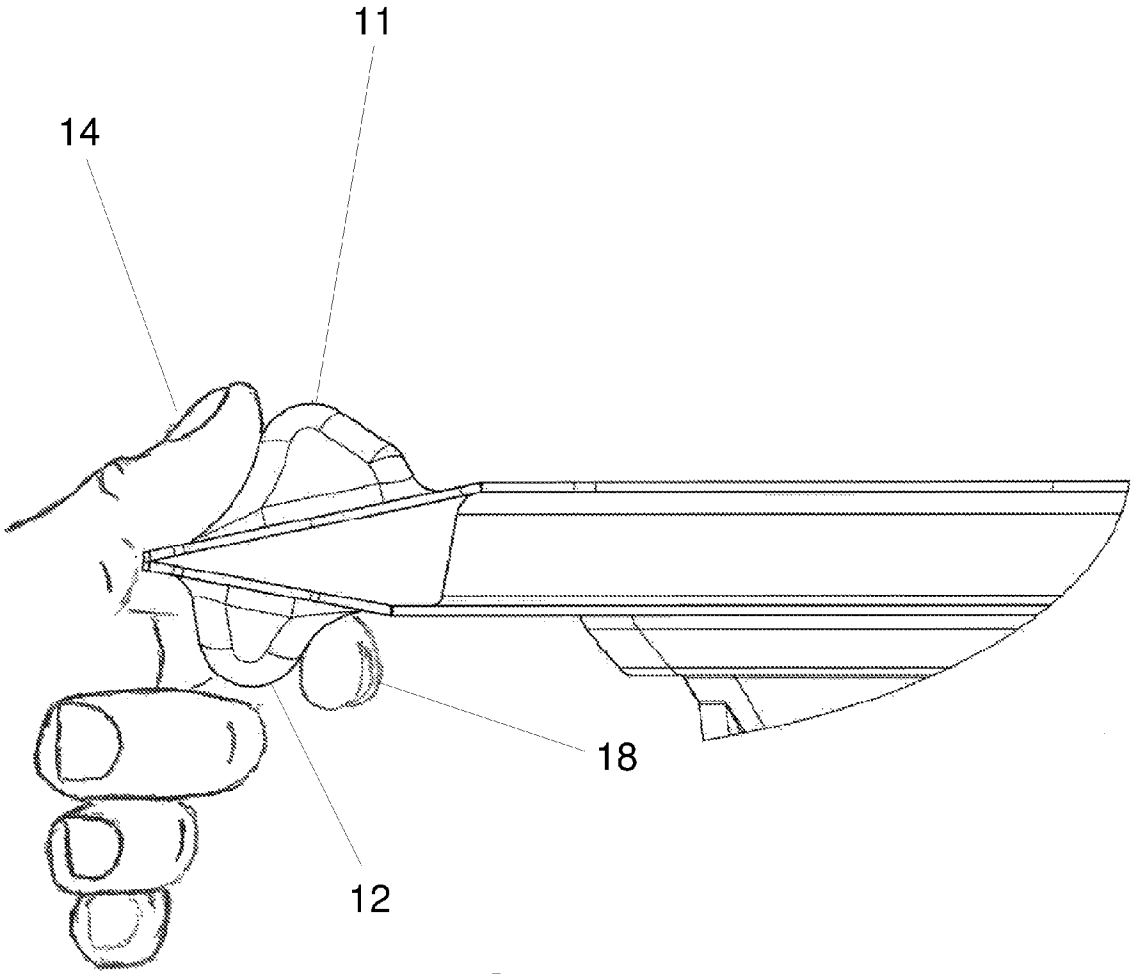
FIG. 11 is an identical detail left elevation view of the hinge area structure of the container in the initially sealed arrangement as shown in FIG. 6, except hand anatomy is included in the image to demonstrate the container opening technique.

Containers with tear-open features can be problematic to open as frequently the most comfortable way to open the container requires that the container be held off a table surface and tilted to so as to best grasp and pill the tear device. However, as shown in FIG. 11 container 1 can be opened in a simpler, neater fashion that allows the container to be opened while it lies upon a table top. Specifically, to open the container a pushing force is applied by the thumb 14 of a user's hand to thumb rest 11 and contemporaneously a pulling force is applied by a finger 18 of the same hand to finger rest 12. The pushing force is horizontally and inwardly directed and the pulling force is horizontally and outwardly directed.

Figure 1:
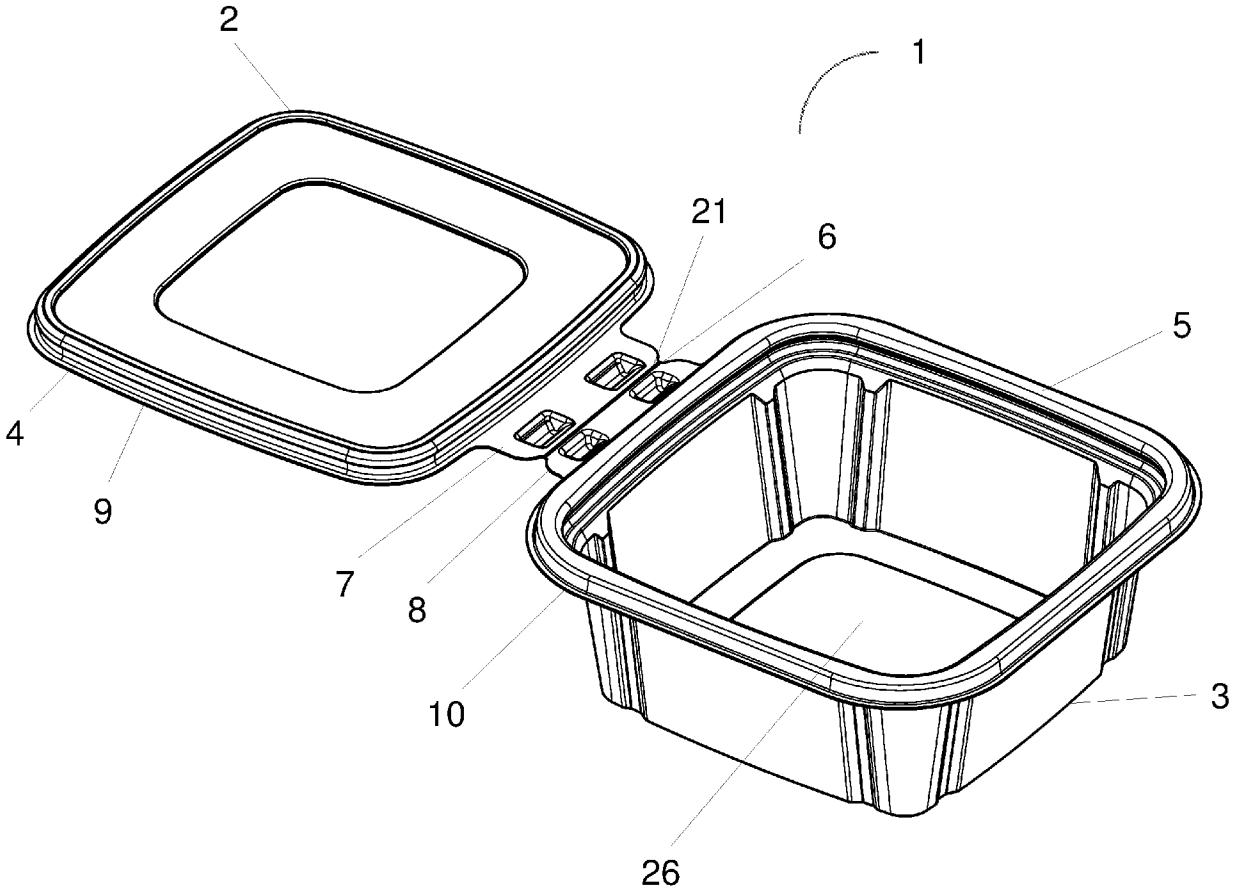
FIG. 1 is a front perspective view of a preferred embodiment of the present invention plastic container in the open arrangement, ready to be filled.
Figure 2:
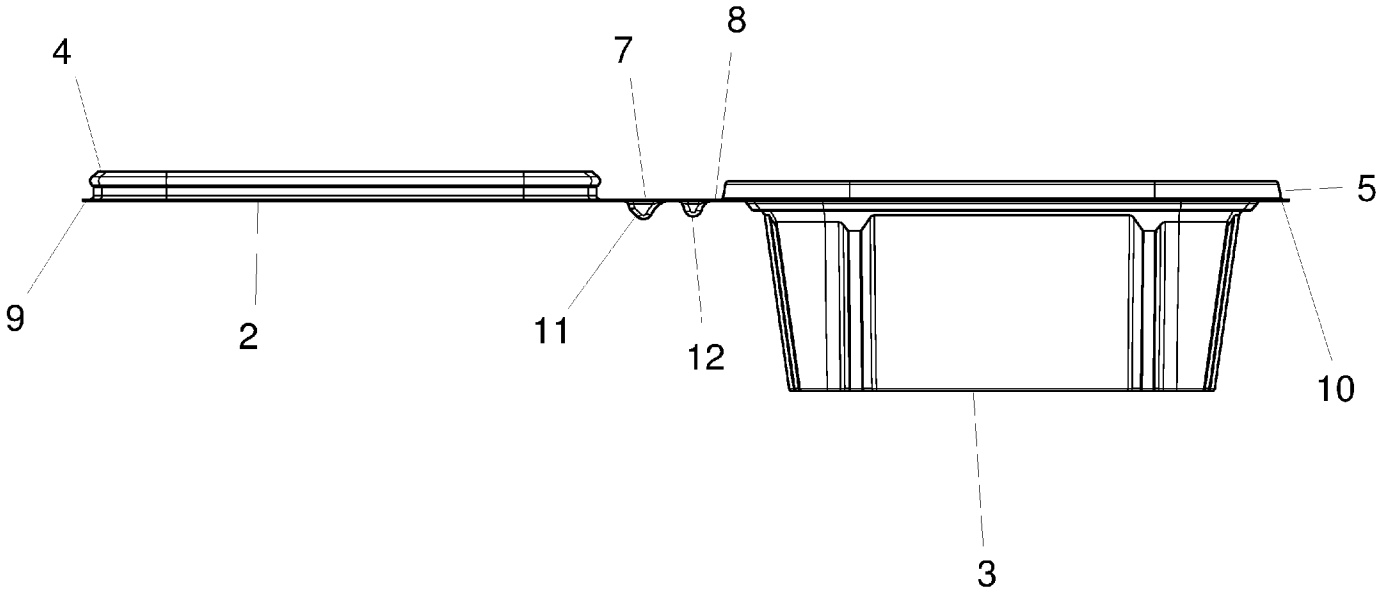
FIG. 2 is a left elevation view of the preferred embodiment container in the open arrangement.
Figure 3:
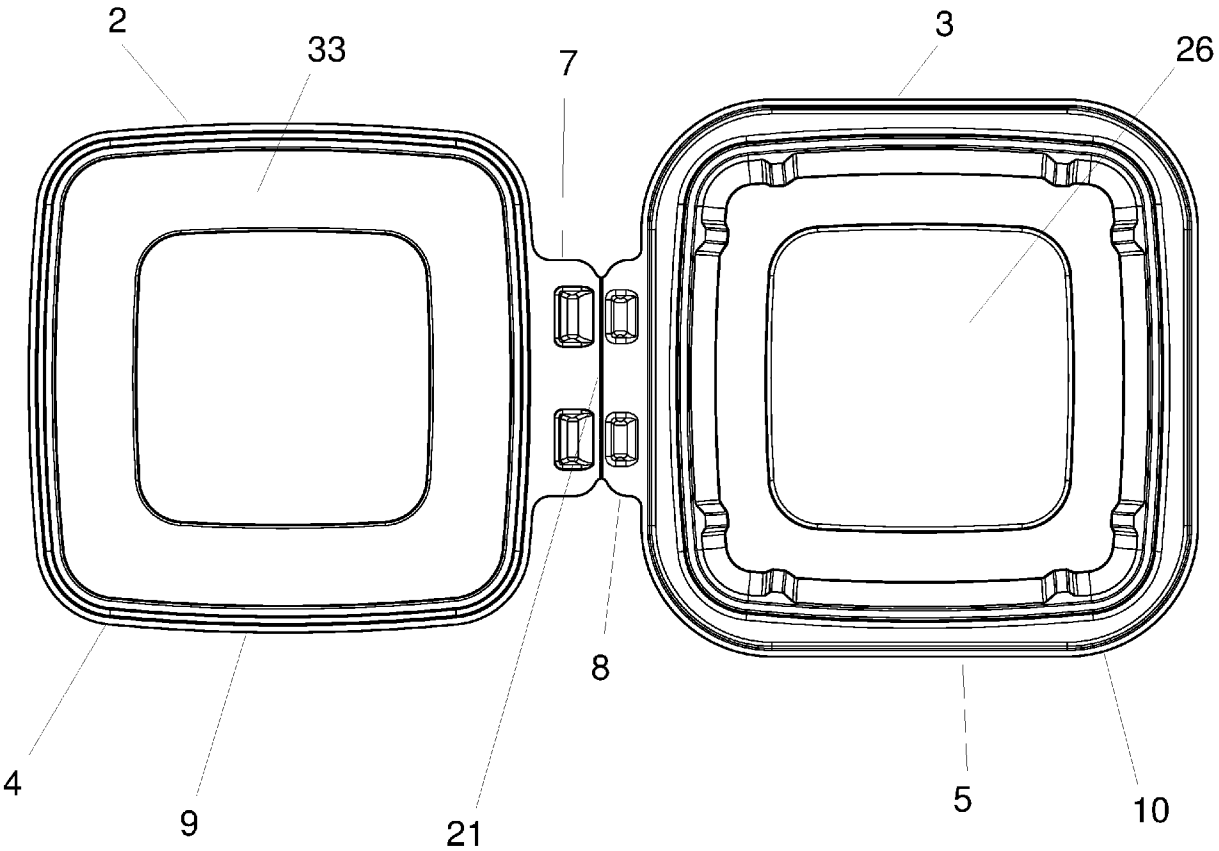
FIG. 3 is a top plan view of the preferred embodiment container in the open arrangement.
Figure 4:
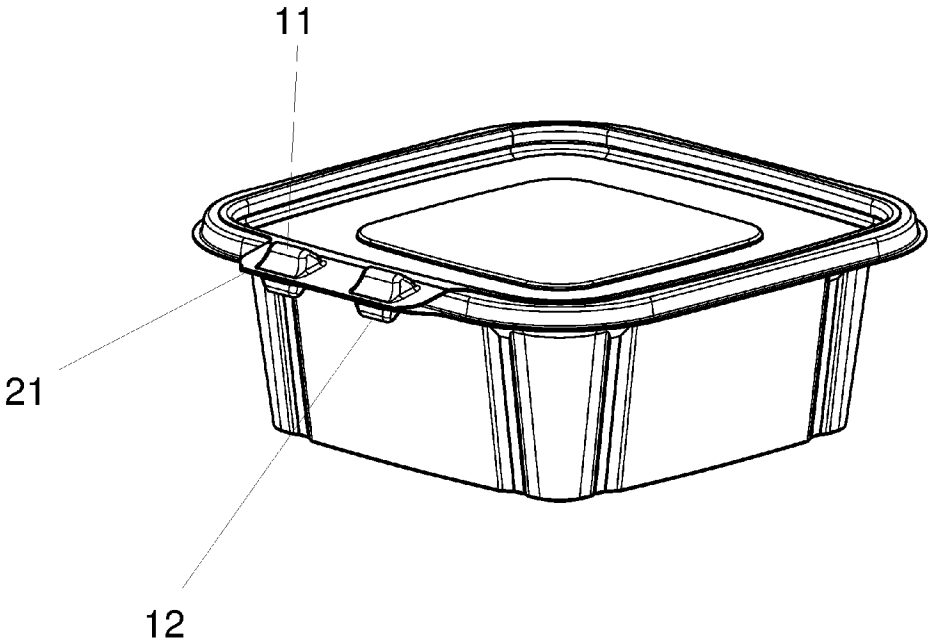
FIG. 4 is a rear perspective view of a preferred embodiment of the present invention plastic container in the initially sealed arrangement.
Figure 5:
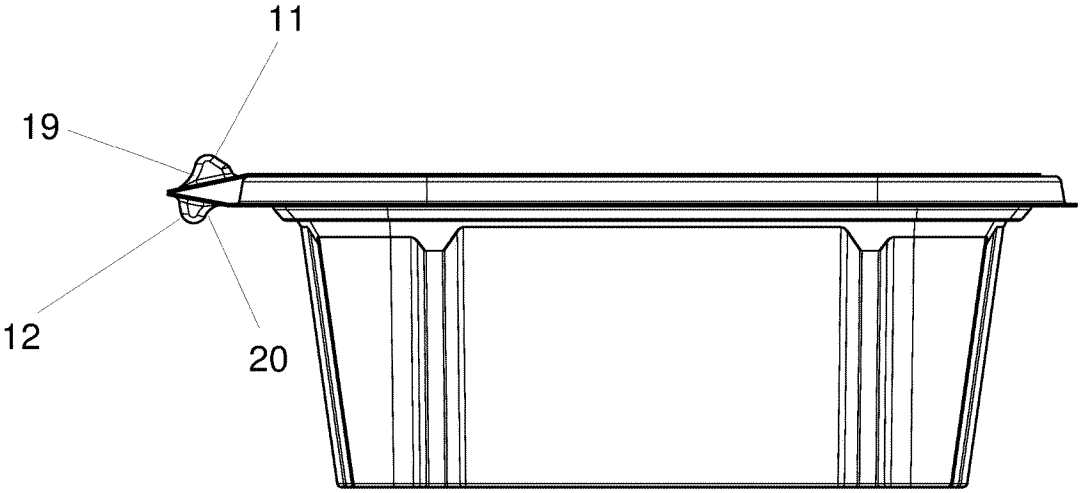
FIG. 5 is a left elevation view of the preferred embodiment container in the initially sealed arrangement.

Hinge 6 is frangible and its length can be seen best in FIGS. 1, 3 and 4. Container 1 is preferably thermoformed from a single sheet of plastic. Hinge 6 can be manufactured by thinning, scoring or making perforations in a line 21 across the segment of material that joins lid 2 to base 3 (to make segments 7, 8). The remnant 21*a* of frangible line 21 after opening can be seen in FIG. 9. The process of thinning, scoring or perforating serves to concentrate the point of articulation during closing of the container at the vertex and not on other sections of the container. Also, the process of thinning, scoring or perforating operates to make hinge 6 frangible and determines the amount of separation force needed to rupture hinge 6. In the preferred embodiment, the material connecting hinge 6 to lid rim flange 9 forms lid hinge segment 7. The material connecting hinge 6 to base rim flange 10 forms base hinge segment 8. In an alternate embodiment lid rim 2 will lack lid rim flange 9 and lid hinge segment 7 will attach directly to lid rim 4. In similar fashion base rim 3 will lack base rim flange 10 and base hinge segment 8 will attach directly to base rim 5.

In a preferred embodiment thumb rest 11 is integrally formed or molded from lid hinge segment 7 and is embossed upon top surface 16. Likewise, finger rest 12 can be integrally formed or molded from base hinge segment 8 and is embossed upon bottom 17. The container can be of any desired shape, including polygonal as shown in the figures.

A container constructed in accordance with the present invention can be manufactured in a variety of shapes and sizes, and is preferably formed of resins or plastic materials including, but not limited to, polyethylene, polypropylene, polyvinyl chloride or polyethylene terephthalate ("PET"). The container is preferably thermoformed, but can be blow-molded or injection molded. The container lid and base can be transparent or translucent, and may be colored in either instance.

Having described the invention in detail, those skilled in the art will appreciate that modifications may be made of the invention without departing from its spirit. Therefore, it is not intended that the scope of the invention be limited to the specific embodiment illustrated and described.

What is claimed is:

1. A tamper evident plastic container capable of assuming an open arrangement and an initially sealed arrangement, the container comprising:

a lid and a base;

the lid including a cover surface and a lid rim, the lid rim including a peripherally projecting lid rim flange;

the base including a base rim, the base rim including a peripherally projecting base rim flange;

a lid hinge segment projecting outwardly and downwardly from the lid rim flange and a base hinge segment projecting outwardly and upwardly from the base rim flange;

the lid hinge segment including a thumb rest and the base hinge segment including a finger rest;

the thumb rest being positioned, sized and shaped to receive an inwardly directed pushing force applied by a user's thumb;

the finger rest being positioned, sized and shaped to receive an outwardly directed pulling force from a finger on the same hand of the user when the thumb of the user's hand is in contact with the thumb rest; and the lid hinge segment and the base hinge segment converging to form a frangible hinge.

2. The container of claim 1 wherein the frangible hinge is vertically situated at a position interposed between the height of the lid rim flange and the height of the base rim flange.

3. The container of claim 1 wherein the thumb rest is integrally formed in the lid hinge segment.

4. The container of claim 1 wherein the finger rest is integrally formed in the base hinge segment.

5. The container of claim 3 wherein the finger rest is integrally formed in the base hinge segment.

6. A tamper evident plastic container capable of assuming an open arrangement and an initially sealed arrangement, the container comprising:

a lid and a base;

the lid including a cover surface and a lid rim, the lid rim circumferentially extending about the periphery of the lid;

the base including a base rim circumferentially extending about the periphery of the base;

the lid rim including a peripherally projecting lid rim flange and the base rim including a peripherally projecting base rim flange;

a lid hinge segment projecting from the lid rim flange and a base hinge segment projecting from the base rim flange;

the lid hinge segment including a thumb rest projecting upwardly from the lid hinge segment and the base hinge segment including a finger rest projecting downwardly from the base hinge segment;

the thumb rest has an outer side and the outer side of the thumb rest is concave; and a vertex defining a frangible hinge, the vertex being vertically situated at a position interposed between the height of the lid rim flange and the height of the base rim flange.

7. The container of claim 6 wherein:

the finger rest has an inner side and the inner side of the finger rest is concave.

8. A tamper evident plastic container capable of assuming an open arrangement and an initially sealed arrangement, the container comprising:

a lid and a base;

the lid including a cover surface and a lid rim, the lid rim circumferentially extending about the periphery of the lid;

the base including a base rim circumferentially extending about the periphery of the base;

the lid rim including a peripherally projecting lid rim flange and the base rim including a peripherally projecting base rim flange;

a lid hinge segment projecting from the lid rim flange and a base hinge segment projecting from the base rim flange;

the lid hinge segment including a thumb rest projecting upwardly from the lid hinge segment and the base hinge segment including a finger rest projecting downwardly from the base hinge segment;

the finger rest has an inner side and the inner side of the finger rest is concave; and a vertex defining a frangible hinge, the vertex being vertically situated at a position interposed between the height of the lid rim flange and the height of the base rim flange.

* * * * *